US010098408B2

(12) United States Patent
Siegismund

(10) Patent No.: US 10,098,408 B2
(45) Date of Patent: Oct. 16, 2018

(54) SHOE, IN PARTICULAR A SPORTS SHOE

(71) Applicant: PUMA SE, Herzogenaurach (DE)

(72) Inventor: Andreas Siegismund, Rückersdorf (DE)

(73) Assignee: PUMA SE, Herzogenaurach (DE)

( * ) Notice: Subject to any disclaimer, the term of this patent is extended or adjusted under 35 U.S.C. 154(b) by 0 days.

(21) Appl. No.: 15/536,232

(22) PCT Filed: Dec. 18, 2014

(86) PCT No.: PCT/EP2014/003415
§ 371 (c)(1),
(2) Date: Jun. 15, 2017

(87) PCT Pub. No.: WO2016/095938
PCT Pub. Date: Jun. 23, 2016

(65) Prior Publication Data

US 2017/0360140 A1 Dec. 21, 2017

(51) Int. Cl.
*A43B 1/02* (2006.01)
*A43B 1/10* (2006.01)
(Continued)

(52) U.S. Cl.
CPC ..... *A43B 1/04* (2013.01); *A43B 5/06* (2013.01); *A43B 23/024* (2013.01); *A43B 23/026* (2013.01); *A43B 23/027* (2013.01); *A43B 23/0215* (2013.01); *A43B 23/0235* (2013.01); *A43B 23/0295* (2013.01); *A43B 23/042* (2013.01); *D04B 1/22* (2013.01); *D10B 2403/0113* (2013.01); *D10B 2501/043* (2013.01)

(58) Field of Classification Search
CPC ..... A43B 1/04; A43B 5/06; A43B 23/0215; A43B 23/0235; A43B 23/0295; A43B 23/026; A43B 23/027
USPC ..... 36/45, 49, 84, 87, 102
See application file for complete search history.

(56) References Cited

U.S. PATENT DOCUMENTS 7,424,783 B2 * 9/2008 Meschter ..... A41D 1/04 2/227
7,636,974 B2 * 12/2009 Meschter ..... A43B 23/027 12/142 E (Continued)

FOREIGN PATENT DOCUMENTS

EP 1874149 B1 7/2013
JP 5442170 B1 * 3/2014 ..... A43B 1/14
WO WO 2016053805 A1 * 4/2016 ..... A43B 1/04

*Primary Examiner* — Jameson Collier
(74) *Attorney, Agent, or Firm* — Lucas & Mercanti, LLP

(57) ABSTRACT

A shoe having an upper and a sole connected to the upper. The upper has, at least in part, a knitted material forming its outer surface. To ensure sufficient longitudinal elasticity in the forefoot region and a good fit, along with efficient production, the knitted material includes a first knitted material layer produced from a first thread and a second knitted material layer produced from a second thread arranged on the first knitted material. The second material layer at least partially covers the first material layer. In the region of the front half, as seen in the longitudinal direction of the shoe, and/or in the heel region of the shoe, the second material layer runs, at least in part, in strip form in a direction transverse to the longitudinal direction of the shoe so as to form a number of strips running parallel to one another.

12 Claims, 3 Drawing Sheets

(51) Int. Cl.

| | |
|---|---|
| ***A43B 1/04*** | (2006.01) |
| ***A43B 23/02*** | (2006.01) |
| ***A43B 23/04*** | (2006.01) |
| ***A43B 5/06*** | (2006.01) |
| ***D04B 1/22*** | (2006.01) |

(56) References Cited

U.S. PATENT DOCUMENTS

| | | | | |
|---|---|---|---|---|
| 7,637,032 | B2 * | 12/2009 | Sokolowski | A43B 1/04 36/3 A |
| 8,008,599 | B2 * | 8/2011 | Meschter | A41D 31/02 219/121.69 |
| 8,028,440 | B2 * | 10/2011 | Sokolowski | A43B 1/04 36/45 |
| 8,590,345 | B2 * | 11/2013 | Sokolowski | A43B 1/04 66/170 |
| 8,661,714 | B2 * | 3/2014 | Sussmann | A43B 3/24 36/102 |
| 2004/0261295 | A1 * | 12/2004 | Meschter | A43B 23/027 36/45 |
| 2005/0268497 | A1 * | 12/2005 | Alfaro | A43B 1/0027 36/136 |
| 2005/0282454 | A1 * | 12/2005 | Meschter | A41D 1/04 442/306 |
| 2006/0048413 | A1 * | 3/2006 | Sokolowski | A43B 23/0235 36/45 |
| 2007/0022627 | A1 * | 2/2007 | Sokolowski | A43B 1/04 36/3 A |
| 2009/0014424 | A1 * | 1/2009 | Meschter | A41D 31/02 219/121.69 |
| 2011/0078924 | A1 | 4/2011 | Rackiewicz et al. | |
| 2013/0160323 | A1 * | 6/2013 | Hsiao | A43B 3/248 36/45 |
| 2014/0310984 | A1 | 10/2014 | Tamm et al. | |

* cited by examiner

SHOE, IN PARTICULAR A SPORTS SHOE

The present application is a 371 of International application PCT/EP2014/003415, filed Dec. 18, 2014, the priority of this application is hereby claimed and this application is incorporated herein by reference.

BACKGROUND OF THE INVENTION

The invention relates to a shoe, in particular to a sports shoe, having an upper and a sole, which is connected to the upper, wherein the upper comprises, at least in part, a knitted material forming its outer surface.

Sport shoes are known and commonly used which have a shoe upper which is produced by a knitting process. Sometimes it is more difficult with those shoes, as with those which consist of a classical material and which are produced in a classical manner, to obtain a good fit of the shoe to ensure then a high degree of comfort on the foot of the wearer during use.

SUMMARY OF THE INVENTION

It is the object of the invention to further develop a shoe of the generic kind in such a manner that at an efficient production, i. e. in the present case by use of a knitting process in the production of the shoe upper, a sufficient longitudinal elasticity especially in the forefoot region and simultaneously a good fit is ensured.

A shoe of the generic kind is disclosed in EP 1 874 149 A1. A similar solution is shown in US 2014/0310984 A1.

The solution of this object by the invention is characterized in that the knitted material consists of a first knitted material layer, which is produced from a first thread, wherein the first material layer has arranged on it a second knitted material layer, which is produced from a second thread, wherein the second material layer covers the first material layer at least in part, wherein, in the region of the front half, as seen in the longitudinal direction of the shoe, and/or in the heel region of the shoe, the second material layer runs, at least in parts, in strip form in a direction transverse to the longitudinal direction of the shoe, wherein, in this region, the second material layer forms a number of strips running parallel to one another.

Between the strips, which run parallel to one another, preferably regions are arranged which are formed by the first material layer and which are free or at least substantial free from the material of the second material layer.

The strips, which run parallel to one another, have preferably a width transverse to the longitudinal direction which is between 40% and 100% of the width of the upper at the location of the strips. The width of the strips, which run parallel to one another, can thereby decrease in the front half of the shoe in the direction to the toe-cap.

Preferably, between 4 and 14 strips, running parallel to one another, are arranged in the front half of the shoe.

The strips which run parallel to one another have preferably an extension in longitudinal direction of the shoe or in vertical direction which is between 1.5 mm and 4.0 mm. The free region between the strips is preferably between 1.0 and 4.0 mm.

The strips which run parallel to one another are preferably arranged in the forefoot region of the shoe and/or in the region of the Achilles tendon of the wearer of the shoe. Especially this has to be understood in such a manner that the strips are arranged between the toe joints and the lacing region (thus in the instep region) of the shoe and/or in the heel region during intended use of the shoe.

Preferably, the second material layer merges outside of the region of the strips which run parallel to one another at least partially in a material layer which laminary covers the first material layer.

The strips which run parallel to one another are preferably arranged in a region which lies in a region between 15% and 35% of the total length of the shoe, measured from the front tip of the shoe. Also by this definition the position of the flexible zone in the mentioned section of the foot results which is created by the strip-shaped structure.

The first thread from which the first material layer consists has preferably a higher elasticity than the second thread from which the second material layer consists. The elasticity of the first thread is thereby preferably at least twice as high as the elasticity of the second thread. Thereby, the term elasticity has to be understood in such a manner how big an elongation (in millimeter) of a thread section is when a predetermined test load is applied on the thread.

It has specifically proven itself when the first thread consists of a block copolymer from the components polyurethane and polyethylene glycol; this material is known under the name "Elastan". The second thread consists preferably of polyamide.

The first knitted material layer forms preferably the inner side of the upper. Accordingly it is provided in this case that the shoe upper consists exclusively from the two mentioned material layers.

The knitted material, consisting of the first knitted material layer and the second knitted material layer, is preferably produced by means of a flat knitting machine, wherein the two threads, which form the two material layers, are enmeshed with another.

Accordingly, the proposed shoe has a knitted bootleg, i.e. a knitted shoe upper, which is equipped with a flexible zone in the forefoot region. This flexible zone which is realized by the mentioned strip-shaped structure constitutes a special elongation zone which improves the adaptability of the shoe upper at the foot of the wearer and which allows during use of the shoe an improved comfort. The same applies also with respect to the proposed embodiment of the heel region of the shoe with the described flexible zone. Also here an improved comfort can be obtained, namely in the region of the Achilles tendon of the wearer of the shoe.

The production of the strip-shaped structure is possible in an easy manner for example by use of a flat knitting process by use of two threads, wherein the two threads are enmeshed with another at their contact point and thus form a firm connection.

In the drawings an embodiment of the invention is shown.

DETAILED DESCRIPTION OF THE INVENTION

In the figures a sport shoe 1 and a part of the same respectively is shown. Thereby, for example a running shoe (jogging shoe) is concerned. The shoe 1 has in a known manner an upper 2 which is connected with a sole 3. The upper 2 consists in the present case totally of a knitted material which is produced on a flat knitting machine. Accordingly, the knitted material forms the outer surface 4 of the upper 2.

Figure 1:
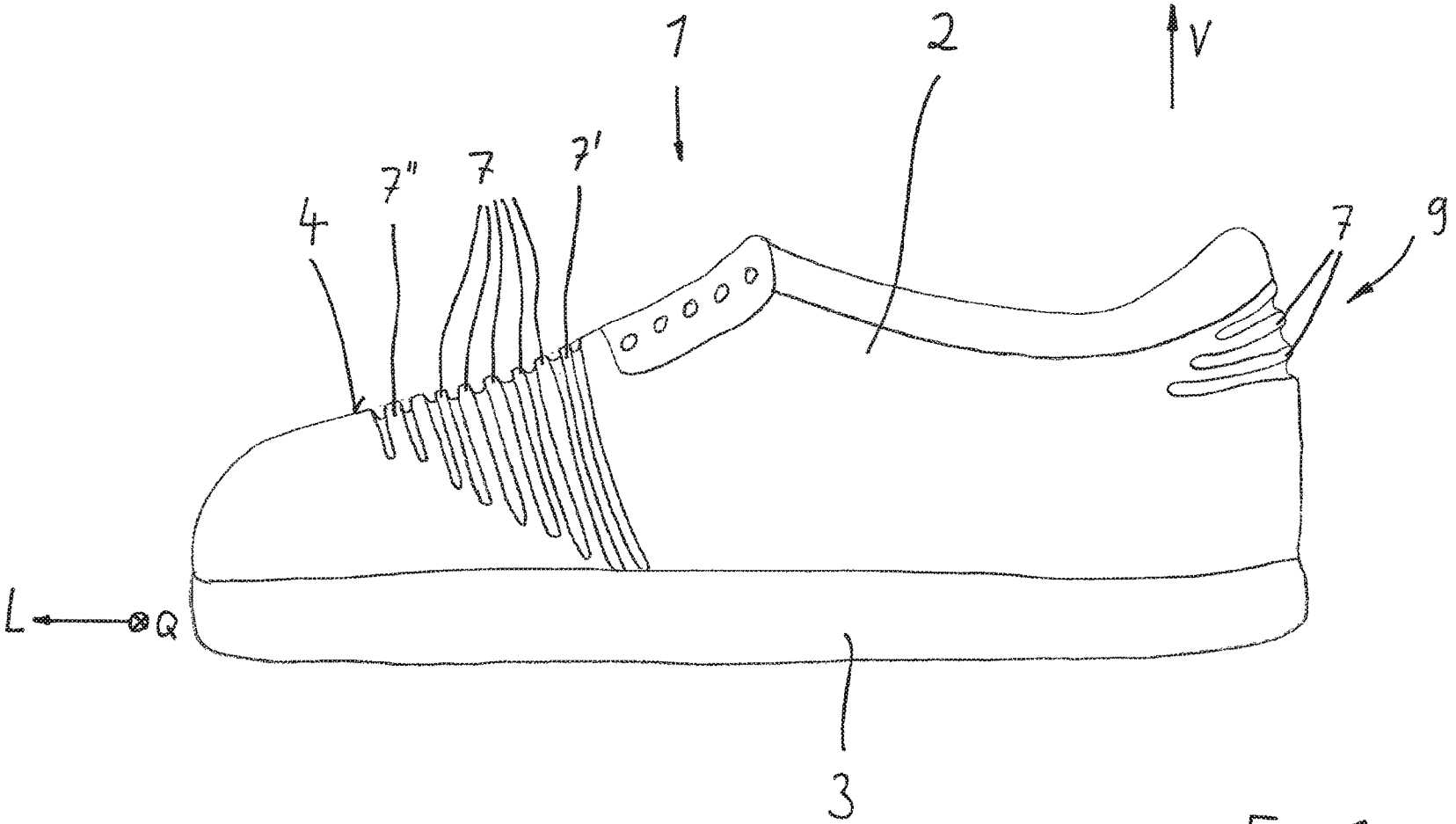
FIG. 1 shows a side view of a shoe according to the invention.

If the shoe 1 is regarded with its longitudinal direction L it can be seen (see for this FIGS. 1 and 2) that a section is provided in the forefoot region which is designed as a flexible zone. This zone is realized by a number of strips 7 which specific design becomes apparent from the synopsis of the figures especially under consideration of FIG. 3. The same applies in the present case also for the heel region 9 of the shoe 1, i. e. for the region of the Achilles tendon of the wearer of the shoe. Also here a number of strips 7 of the following described kind is arranged to create a flexible zone. The strips 7 are spaced apart here in vertical direction V.

Figure 3:
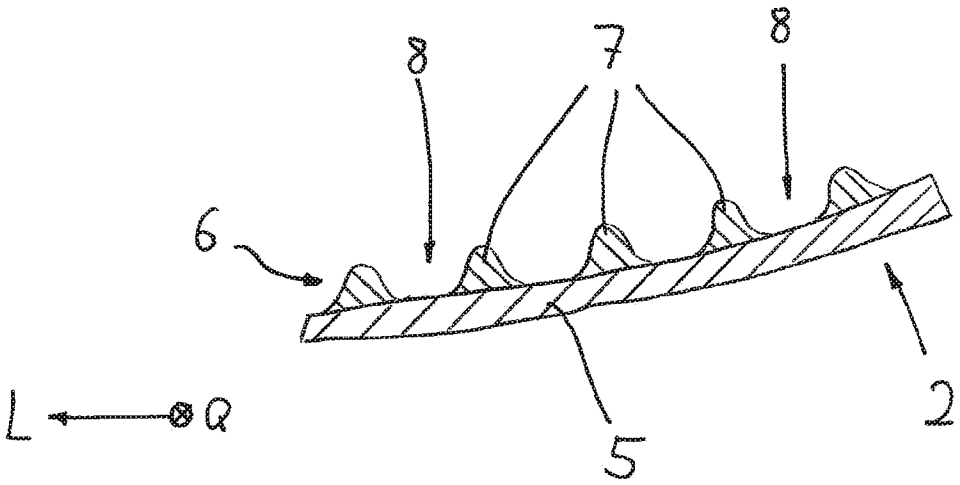
FIG. 3 shows a part of the section C-C according to FIG. 2 through a section of the shoe upper.

From FIG. 3 it becomes apparent that the knitted material consists of a first knitted and continuous material layer 5 which is produced from a first thread. On the first material layer 5 a second knitted material layer 6 is arranged which is produced from a second thread. Thereby, the second material layer 6 covers the first material layer 5 partially, more precisely, the second material layer 6 is largely arranged laminar over the first material layer 5, but with the exception of the mentioned flexible zone. Here, thus in the forefoot region of the shoe, the second material layer 6 runs strip-shaped transverse (s. transversal direction Q) to the longitudinal direction L of the shoe, wherein the second material layer 6 forms here a number of strips 7 which run parallel one to another.

Figure 2:
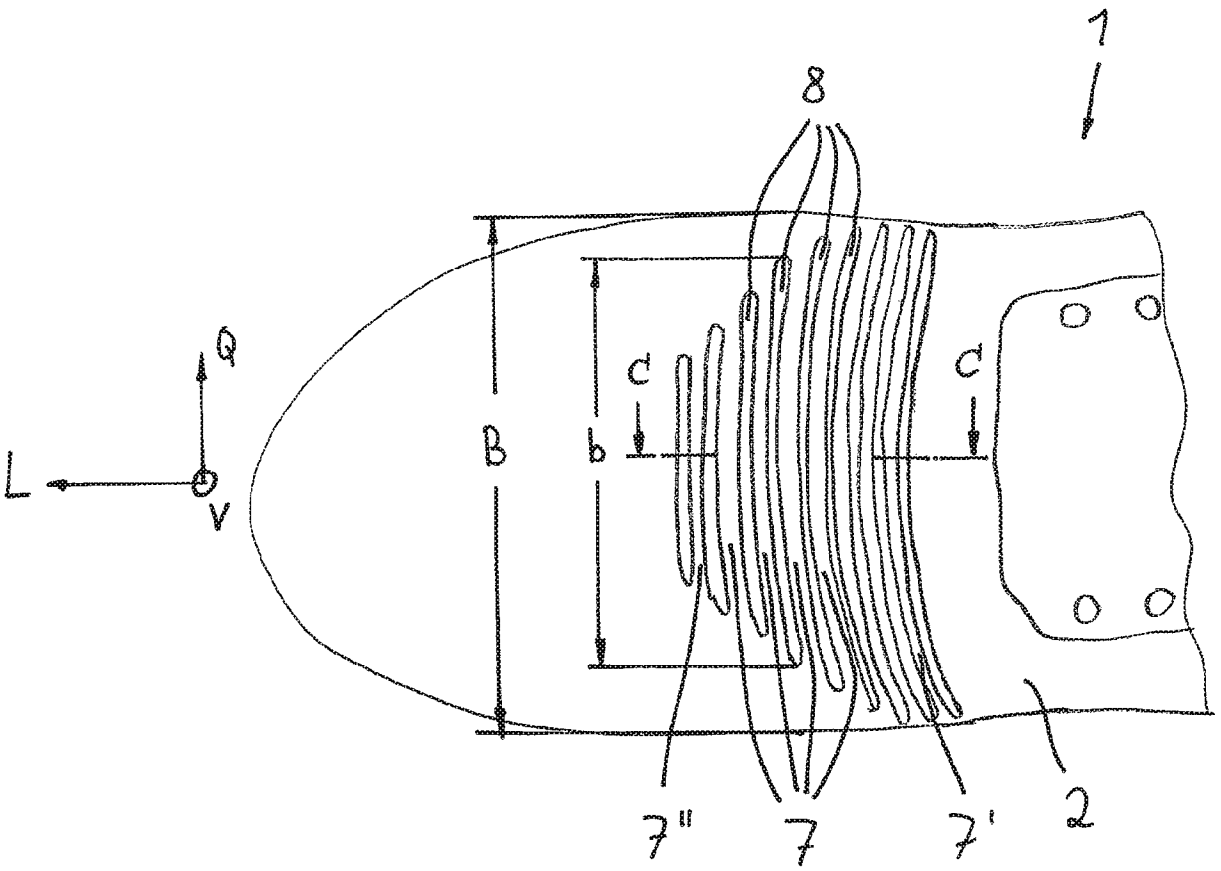
FIG. 2 shows a top view onto the front part of the sports shoe according to FIG. 1

As results from FIGS. 2 and 3 a free region 8 is arranged between the strips 7 which is formed (substantial) exclusively by the first material layer 5.

Thereby, it is preferably provided that both material layers—i.e. the first material layer 5 and the second material layer 6—run continuously (accordingly the region between the strips is not completely free, it consists thus not only of the material of the first material layer 5). Thereby, the first material layer 5 forms the basis on which the second material layer 6 is arranged. However, the second material layer 6 is only connected with the first material layer 5 at the deepest points of the wave shape and strip shape respectively. The second material layer 6 has preferably a higher number of knitted stitch courses than the first material layer 5, which is why it archs upward tube-like and forms so the strips 7.

In the embodiment eight strips 7 are provided which run transverse to the longitudinal axis L, wherein the second material layer, which forms the strips 7, is arranged on the first material layer outside of the mentioned flexible zone substantially laminar and covering.

The strips 7 can be designed lightly arcuated as can be seen from FIG. 2. Furthermore it is provided in the embodiment that the width b of the strips—measured substantially in direction Q transverse to the longitudinal direction L—decreases to the tip of the shoe. While the strip 7' which is arranged furthest rear still runs along the complete width of the upper 2, thus till down to the sole 3 (see FIG. 1 for this) the width b of the strips decreases in the direction to the shoe tip; the furthermost ahead arranged strip 7" has only approximately a width b which is in the top plan view (according to FIG. 2) about 40% of the width B of the upper 2.

As the thread of the first material layer 5 is substantially more elastic than the thread of the second material layer 6 it results accordingly in a beneficial manner that the upper 2 is very much more elastic in the region which is provided with the strips 7 as it would be the case if the strips 7 and namely the free regions 8 would not be present.

However, by the described strip-shaped structure it is ensured that the upper has a substantial unaffected elasticity in the direction Q transverse to the longitudinal direction L, i.e. the shoe upper has here almost the same stability against elongation as in the other regions.

By the production by knitting, in the present case by use of a flat knitting machine, the material of the upper can be produced accurately fitting and economical.

REFERENCE NUMERALS

1 Shoe
2 Upper
3 Sole
4 Outer surface of the upper
5 First knitted material layer
6 Second knitted material layer
7 Strip
7' Strip
7" Strip
8 Free region
9 Heel region (region of the Achilles tendon of the wearer of the shoe)
L Longitudinal direction of the shoe
Q Direction transverse to the longitudinal direction
V Vertical direction
b Width of the strip
B Width of the upper

The invention claimed is:

1. A shoe comprising: an upper and a sole, the sole being connected to the upper, the upper including, at least in part, a knitted material forming an outer surface of the upper, wherein the knitted material consists of a first knitted material layer, which is produced from a first thread, and a second knitted material layer, which is produced from a second thread, the second knitted material layer being arranged on and covering the first knitted material layer at least in part, wherein, in a forefoot region in a front half of the shoe, with respect to a longitudinal direction of the shoe, the second knitted material layer forms a plurality of strips running parallel to one another in a direction transverse to the longitudinal direction of the shoe, wherein in an area of the outer surface of the upper that is separate from the forefoot region, the second knitted material layer is arranged over and covers the first knitted material layer as a laminar layer, wherein the strips of the second knitted material layer are arranged on the first knitted material layer and define free regions disposed between the strips in which an outer surface of the first knitted material layer is exposed and which are free from the material of the second knitted material layer, and wherein each of the strips has a width transverse to the longitudinal direction of the shoe between 40% and 100% of a width of the upper at a location of the respective strip, the strips including rear strips and front strips, the front strips disposed in front of the rear strips in the longitudinal direction of the shoe, the width of the front strips decreases in a direction toward a toe-cap of the shoe and the width of the front strips is smaller than the width of the upper at the location of the front strips such that opposing ends of the front strips are spaced away from the sole.

2. The shoe according to claim 1, wherein the plurality of strips includes between 4 and 14 strips arranged in the front half of the shoe.

3. The shoe according to claim 1, wherein the strips have an extension in the longitudinal direction of the shoe or in a vertical direction between 1.5mm and 4.0 mm.

4. The shoe according to claim 1, wherein the forefoot region in which the strips are arranged lies in a region between 15% and 35% of a total length of the shoe, the total length of the shoe defined as a length measured from a front tip of the shoe to a rear tip of the shoe.

5. The shoe according to claim 1, wherein the first thread from which the first knitted material layer consists has a higher elasticity than the second thread from which the second knitted material layer consists.

6. The shoe according to claim 5, wherein the elasticity of the first thread is at least twice as high as the elasticity of the second thread.

7. The shoe according to claim 5, wherein the first thread consists of a block copolymer from components polyurethane and polyethylene glycol.

8. The shoe according to claim 5, wherein the second thread consists of polyamide.

9. The shoe according to claim 1, wherein the first knitted material layer forms an inner side of the upper.

10. The shoe according to claim 1, wherein the knitted material, consisting of the first knitted material layer and the second knitted material layer, is produced by a flat knitting machine, wherein the two threads, which form the knitted material layers, are enmeshed with one another.

11. The shoe according to claim 1, wherein additional strips are arranged in a heel region configured to be in a region of an Achilles tendon of the user of the shoe.

12. The shoe according to claim 1, wherein a frontmost strip of the front strips that is closest to the toe-cap of the shoe has a width of about 40% of the width of the upper at the location of the frontmost strip.

* * * * *